US007664284B2

(12) United States Patent
Zhang et al.

(10) Patent No.: US 7,664,284 B2
(45) Date of Patent: Feb. 16, 2010

(54) MICROPHONE ARRAY IN HOUSING

(75) Inventors: Ming Zhang, Cupertino, CA (US); Lili Chen, Nanjing (CN); Bo Zhang, Nanjing (CN)

(73) Assignee: Fortemedia, Inc., Cupertino, CA (US)

( * ) Notice: Subject to any disclaimer, the term of this patent is extended or adjusted under 35 U.S.C. 154(b) by 0 days.

(21) Appl. No.: 11/771,006

(22) Filed: Jun. 29, 2007

(65) Prior Publication Data

US 2008/0069389 A1 Mar. 20, 2008

Related U.S. Application Data

(60) Provisional application No. 60/825,590, filed on Sep. 14, 2006.

(51) Int. Cl.
*H04R 25/00* (2006.01)

(52) U.S. Cl. ..... 381/355; 381/356; 381/365

(58) Field of Classification Search ..... 381/92, 381/313, 322, 324, 328, 330, 338, 355, 356, 381/358, 361, 357, 420.03, 365; 379/431, 379/433.03, 420.03

See application file for complete search history.

(56) References Cited

U.S. PATENT DOCUMENTS

| | | | | |
|---|---|---|---|---|
| 3,458,668 | A * | 7/1969 | Hassler | 381/313 |
| 5,121,426 | A * | 6/1992 | Baumhauer et al. | 379/420.03 |
| 6,151,399 | A * | 11/2000 | Killion et al. | 381/313 |
| 7,151,839 | B2 * | 12/2006 | Niederdrank | 381/324 |
| 2007/0127759 | A1 * | 6/2007 | Zhang et al. | 381/338 |
| 2008/0013770 | A1 * | 1/2008 | Wu et al. | 381/357 |

* cited by examiner

*Primary Examiner*—Huyen D Le
(74) *Attorney, Agent, or Firm*—Thomas, Kayden, Horstemeyer & Risley

(57) ABSTRACT

An electronic device includes a circuit board, a first microphone module, and a second microphone module. The first microphone module includes a first omnidirectional microphone connected to the circuit board, a first boot also connected to the circuit board, and a first tube extending from the first boot. The second microphone module includes a second omnidirectional microphone connected to the circuit board, a second boot also connected to the circuit board, and a second tube extending from the second boot. The first and second omnidirectional microphones are identical, and the first and second boots are identical.

12 Claims, 10 Drawing Sheets

MICROPHONE ARRAY IN HOUSING

CROSS REFERENCE TO RELATED APPLICATIONS

This application claims the benefit of U.S. Provisional Application No. 60/825,590, filed on Sep. 14, 2006.

BACKGROUND OF THE INVENTION

1. Field of the Invention

The invention relates to a microphone array in a housing of an electronic device capable of adequate performance.

2. Description of the Related Art

A typical microphone array includes a number of microphones disposed in tandem. A simple example is shown in FIG. 1, wherein the microphone array 10 includes two microphones 11 and 12 placed side by side. Directivities of the microphone array 10 can be achieved by manipulating the signal received by the two microphones 11 and 12. Assuming the two microphones 11 and 12 are omni-directional and have the same characteristics, the directivity of the microphone array 10 depends on the distance D between the two microphones 11 and 12.

The disclosed microphones 11 and 12 are placed in an open space for achieving directivity. Most electronic devices (cellular phones, personal digital assistants, etc.), however, have plastic or metal housings, which are acoustic isolators. Acoustic isolators block audio signals increasing difficulty in placing microphones.

BRIEF SUMMARY OF THE INVENTION

The invention provides an electronic device comprising an internal microphone array capable of adequate performance.

In an exemplary embodiment of the invention, the electronic device includes a circuit board and two microphone modules. The two microphone modules are identical, mounted on the circuit board, and acoustically isolated from each other.

Each microphone module may comprise an omnidirectional microphone connected to the circuit board, a boot also connected to the circuit board, and a tube extending from the boot.

The electronic device may further comprise a housing, wherein the circuit board and the microphone modules are disposed in the housing, an opening is defined in the housing, and the tube is connected to the opening.

The boot and the tube may be integral.

The omnidirectional microphone may have a front surface receiving sound, and a rear surface opposing the front surface.

The rear surface of the omnidirectional microphone may be connected to the circuit board.

The omnidirectional microphone may be housed by the boot, forming a cavity by the boot and the front surface of the omnidirectional microphone.

The circuit board may have a first surface and a second surface opposing the first surface. The boot may be connected to the first surface. The front surface of the omnidirectional microphone may be connected to the second surface.

The circuit board may further have a through hole between the boot and the omnidirectional microphone.

The microphone modules may be mounted side-by-side on the circuit board.

The microphone modules may be mounted back-to-back on the circuit board.

The electronic device may comprise a cellular phone, a personal digital assistant, or a global positioning system receiver.

In another exemplary embodiment of the invention, the electronic device may comprise a circuit board, a first microphone module, and a second microphone module. The first microphone module may comprise a first omnidirectional microphone connected to the circuit board, a first boot also connected to the circuit board, and a first tube extending from the first boot. The second microphone module may comprise a second omnidirectional microphone connected to the circuit board, a second boot also connected to the circuit board, and a second tube extending from the second boot. The first and second omnidirectional microphones are identical, and the first and second boots are identical.

The electronic device may further comprise a housing, wherein the circuit board, the first microphone module, and the second microphone module are disposed in the housing, a first opening and a second opening are defined in the housing, the first tube is connected to the first opening, and the second tube is connected to the second opening.

The first tube and the second tube may be parallel.

The first tube and the second tube may be not parallel.

The first omnidirectional microphone may have a first front surface receiving sound and a first rear surface opposing the first front surface, and the second omnidirectional microphone may have a second front surface receiving the sound and a second rear surface opposing the second front surface.

The first omnidirectional microphone may be housed by the first boot. A first cavity may be formed between the first boot and the first front surface of the first omnidirectional microphone. The second omnidirectional microphone may be housed by the second boot. A second cavity may be formed between the second boot and the second front surface of the second omnidirectional microphone. The first and second cavities may be identical.

The circuit board may have a first surface and a second surface opposing the first surface. The first omnidirectional microphone, the second omnidirectional microphone, the first boot, and the second boot may be connected to the first surface.

The circuit board may have a first surface and a second surface opposing the first surface. The first boot and the second boot may be connected to the first surface. The first omnidirectional microphone and the second omnidirectional microphone may be connected to the second surface.

The circuit board may have a first surface and a second surface opposing the first surface. The first omnidirectional microphone and the first boot may be connected to the first surface. The second omnidirectional microphone and the second boot may be connected to the second surface.

The electronic device may comprise a cellular phone, a personal digital assistant, or a global positioning system receiver.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

While a cellular phone described for the purposes of illustrating the invention, it is understood that the invention is equally applicable to a variety of electronic devices including personal digital assistants (PDAs), global positioning system (GPS) receiver, and others.

Figure 1:
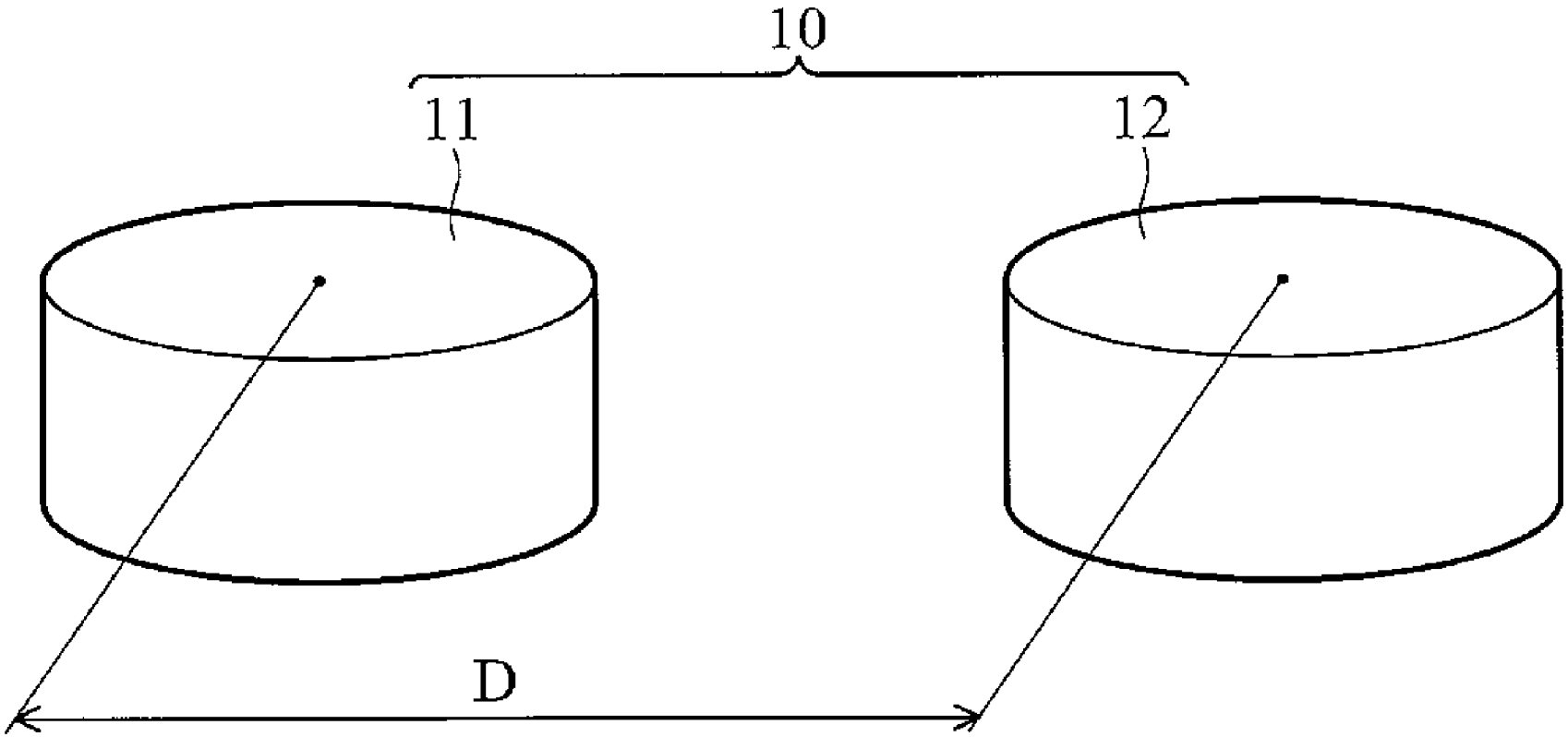
FIG. 1 ( PRIOR ART )
FIG. 1 is a schematic diagram of a microphone array.
Figure 2A:
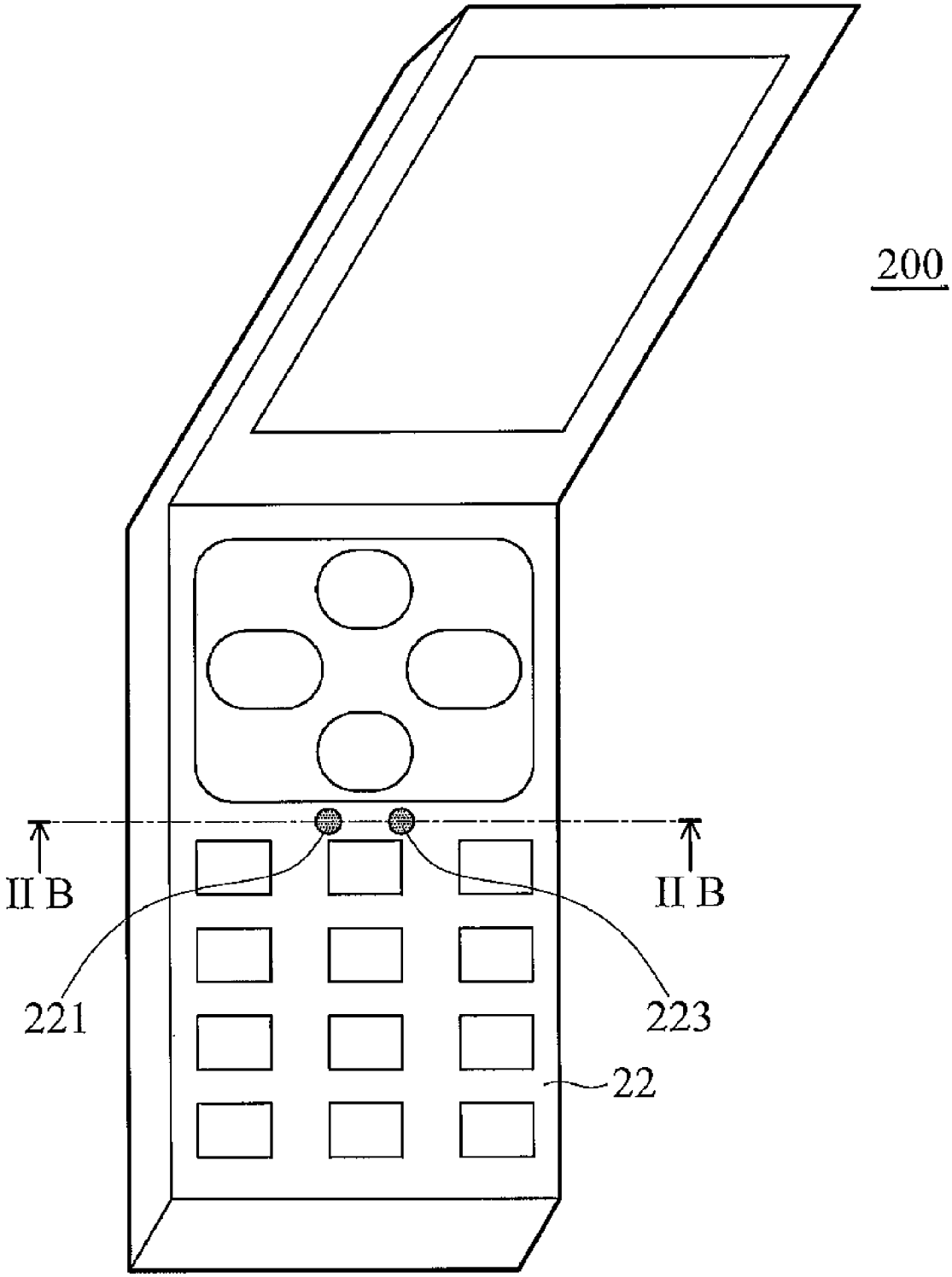
FIG. 2A is a schematic view showing a cellular phone in accordance with a first embodiment of the invention.
Figure 2B:
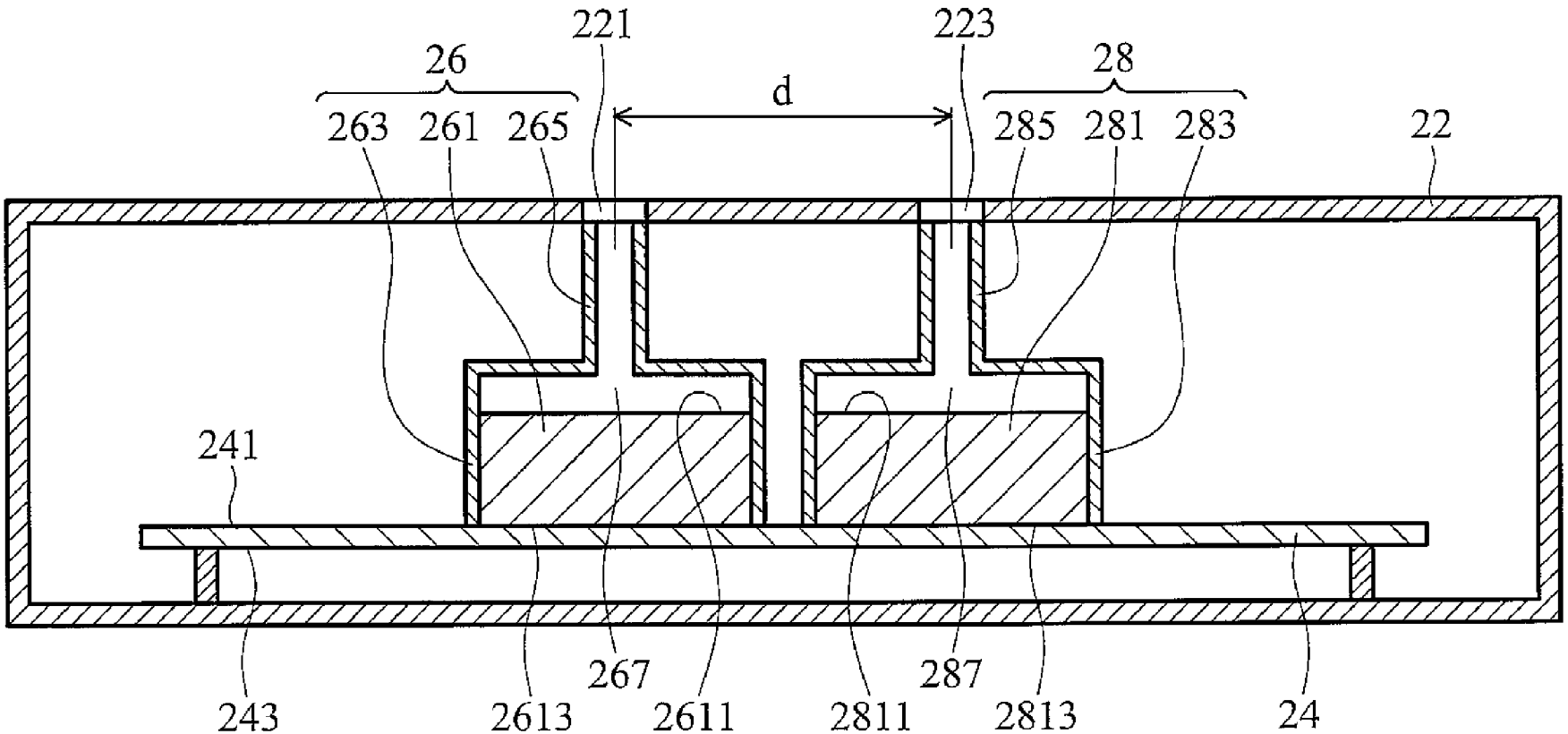
FIG. 2B is a sectional view of FIG. 2A along line IIB-IIB.

Referring to FIGS. 2A and 2B, a cellular phone 200 of a first embodiment of the invention includes a housing 22 in which a circuit board 24, a first microphone module 26, and a second microphone module 28 are disposed. The first microphone module 26 and the second microphone module 28 constitute a microphone array. The housing 22 has a first opening 221 and a second opening 223.

The circuit board 24 has a first surface 241 and a second surface 243 opposing the first surface 241. The first microphone module 26 and the second microphone module 28 are mounted on the first surface 241 of the circuit board 24.

The first microphone module 26 includes a first omnidirectional microphone 261, a first boot 263 housing the first omnidirectional microphone 261, and a first tube 265 extending from the first boot 263 to the first opening 221 of the housing 22. The first boot 263 is connected to the first surface 241 of the circuit board 24 by, for example, glue. The first omnidirectional microphone 261 has a first front surface 2611 receiving external sound via the first tube 265 as well as the first opening 221, and a first rear surface 2613 connected to the first surface 241 of the circuit board 24 via surface-mount technology (SMT). A first cavity 267 is formed between the first boot 263 and the first front surface 2611 of the first omnidirectional microphone 261. In this embodiment, the first boot 263 and the first tube 265 are integral.

The second microphone module 28 includes a second omnidirectional microphone 281, a second boot 283 housing the second omnidirectional microphone 281, and a second tube 285 extending from the second boot 283 to the second opening 223 of the housing 22. The second boot 283 is connected to the first surface 241 of the circuit board 24 by, for example, glue. The second omnidirectional microphone 281 and the first omnidirectional microphone 261 are identical, thus having the same polar pattern and performance. The second omnidirectional microphone 281 has a second front surface 2811 receiving external sound via the second tube 285 as well as the second opening 223, and a second rear surface 2813 connected to the first surface 241 of the circuit board 24 via surface-mount technology (SMT). A second cavity 287 is formed between the second boot 283 and the second front surface 2811 of the second omnidirectional microphone 281. The second boot 283 and the second tube 285 are integral.

In this embodiment, the first and second cavities 267 and 287 are identical, which enables the first omnidirectional microphone 261 in the first boot 263 and the second omnidirectional microphone 281 in the second boot 283 to present the same performance, wherein the first and second omnidirectional microphones 261 and 281 are identical as described above. Furthermore, the first and second cavities 267 and 287 are as small as possible, for reducing the sizes of the first and second boots 263 and 283 to a minimum, saving the space in the cellular phone 200, and maintaining the performance of the first and second omnidirectional microphones 261 and 281 in good shape.

The first omnidirectional microphone 261 is enclosed by the circuit board 24 and the first boot 263, both of which are acoustic isolators. Thus, the first omnidirectional microphone 261 merely receives external sound via the first tube 265. Similarly, the second omnidirectional microphone 281 is enclosed by the circuit board 24 and the second boot 283 both of which are acoustic isolators. Thus, the second omnidirectional microphone 281 merely receives external sound via the second tube 285. It is therefore understood that sound transmission between the first microphone module 26 and the second microphone module 28 is prevented.

The directivity of the microphone array is determined by the distance d between the first opening 221 and the second opening 223. In this embodiment, the first tube 265 and the second tube 285 are parallel. Thus, the distance d between the first opening 221 and the second opening 223 depends on that between the first microphone module 26 and the second microphone module 28.

Figure 3:
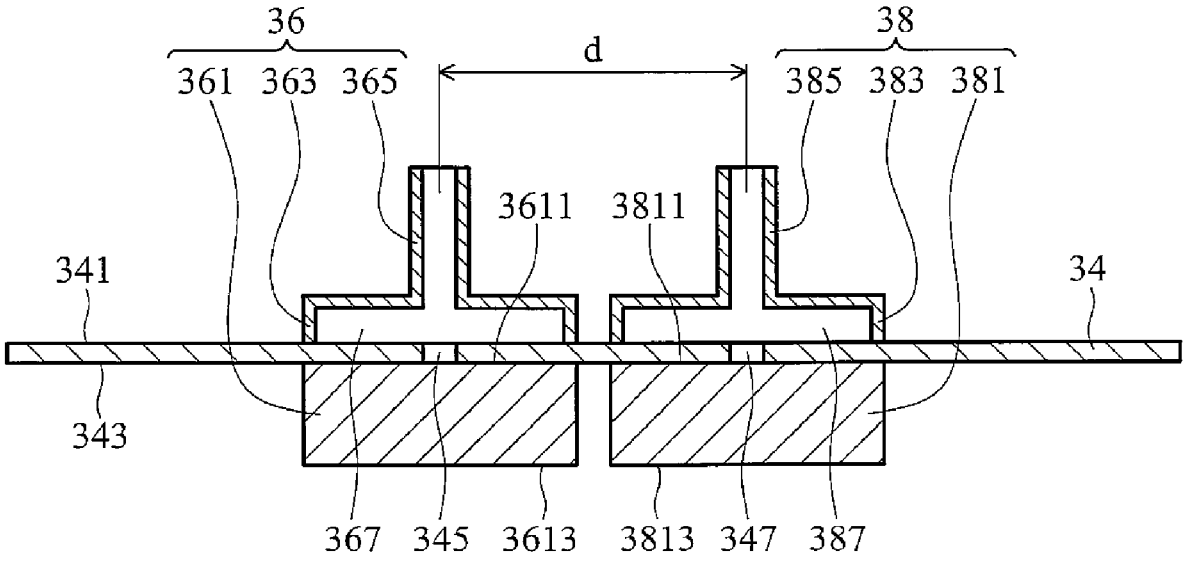
FIG. 3 is a sectional view of a microphone array and a circuit board in accordance with a second embodiment of the invention.

It is understood that the arrangement of the circuit board 24, the first microphone module 26, and the second microphone module 28 can be modified. FIG. 3 depicts a modified arrangement in accordance with a second embodiment of the invention, wherein a first omnidirectional microphone 361 and a second omnidirectional microphone 381 are mounted on a side of a circuit board 34, while a first boot 363 and a second boot 383 are mounted on the other side. The second embodiment of the invention is described in detail as follows.

The circuit board 34 has a first surface 341 and a second surface 343 opposing the first surface 341. A first microphone module 36 includes a first omnidirectional microphone 361, a first boot 363, and a first tube 365, wherein the first tube 365 extends from the first boot 363. In this embodiment, the first boot 363 and the first tube 365 are integral. The first boot 363 is connected to the first surface 341 of the circuit board 34 by, for example, glue. The first omnidirectional microphone 361 has a first front surface 3611 and a first rear surface 3613, wherein the first front surface 3611 is connected to the second surface 343 of the circuit board 34 via surface-mount technology (SMT). The circuit board 34 has a first through hole 345 between the first boot 363 and the first omnidirectional microphone 361. A first cavity 367 is formed in the first boot 363. Thus, external sound is capable of entering the first tube 365, traveling through the first cavity 367 and the first through hole 345, and reaching the first front surface 3611 of the first omnidirectional microphone 361.

A second microphone module 38 includes a second omnidirectional microphone 381, a second boot 383, and a second tube 385, wherein the second tube 385 extends from the second boot 383. In this embodiment, the second boot 383 and the second tube 385 are integral. The second boot 383 is connected to the first surface 341 of the circuit board 34 by, for example, glue. The second omnidirectional microphone 381 has a second front surface 3811 and a second rear surface 3813, wherein the second front surface 3811 is connected to the second surface 343 of the circuit board 34 via surface-mount technology (SMT). The circuit board 34 further has a second through hole 347 between the second boot 383 and the second omnidirectional microphone 381. A second cavity 387 is formed in the second boot 383. Thus, external sound is capable of entering the second tube 385, traveling through the second cavity 387 and the second through hole 347, and reaching the second front surface 3811 of the second omnidirectional microphone 381.

In this embodiment, the first and second cavities 367 and 387 are identical, which enables the first omnidirectional microphone 361 and the second omnidirectional microphone 381 to have the same performance, wherein the first and second omnidirectional microphones 361 and 381 are identical. Furthermore, the first and second cavities 367 and 387 are as small as possible, for reducing the sizes of the first and second boots 363 and 383 to a minimum, saving the space in the cellular phone, and maintaining the performance of the first and second omnidirectional microphones 361 and 381 in good shape.

Figure 4A:
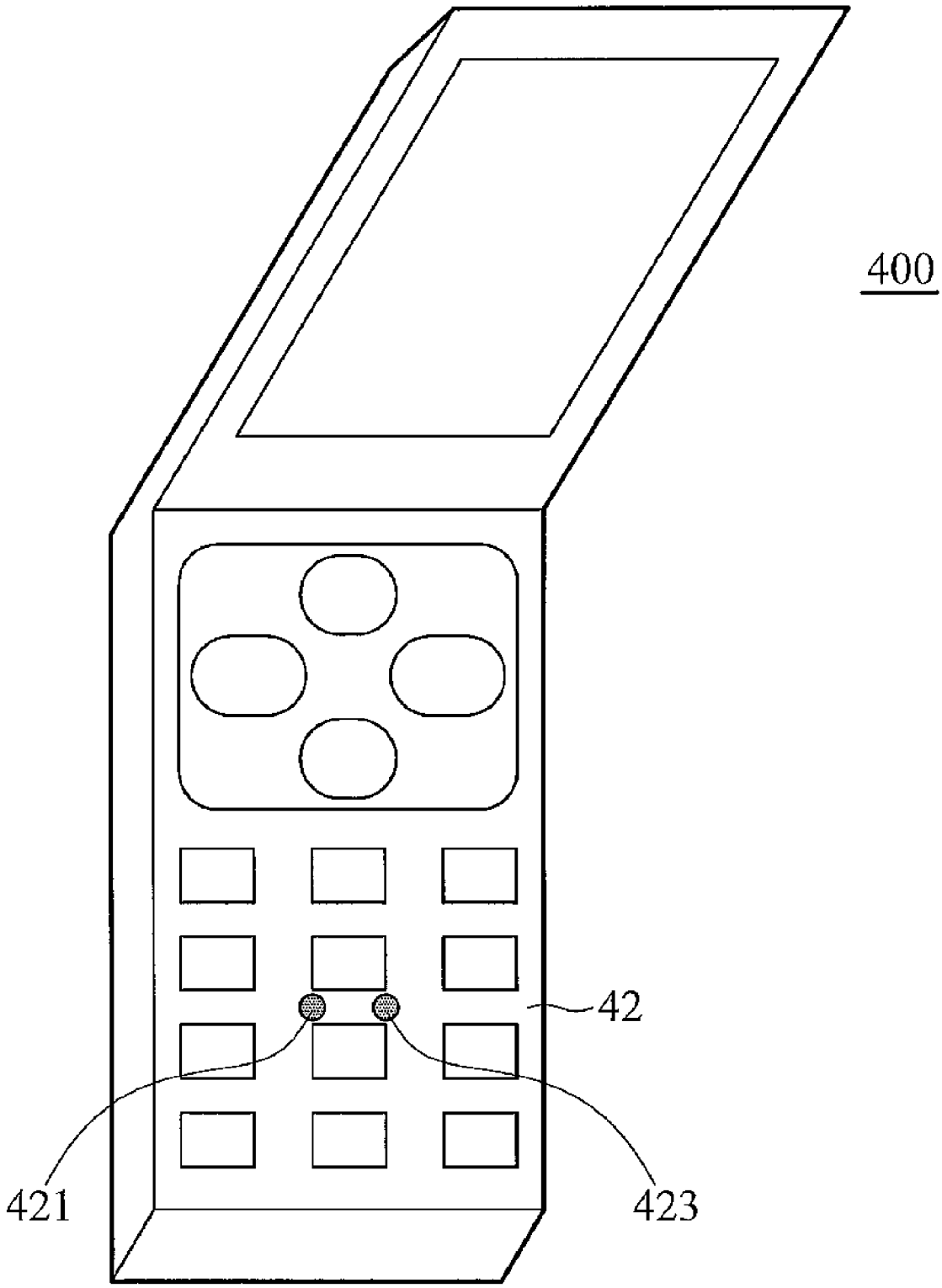
FIG. 4A is a schematic view showing a cellular phone in accordance with a third embodiment of the invention.
Figure 4B:
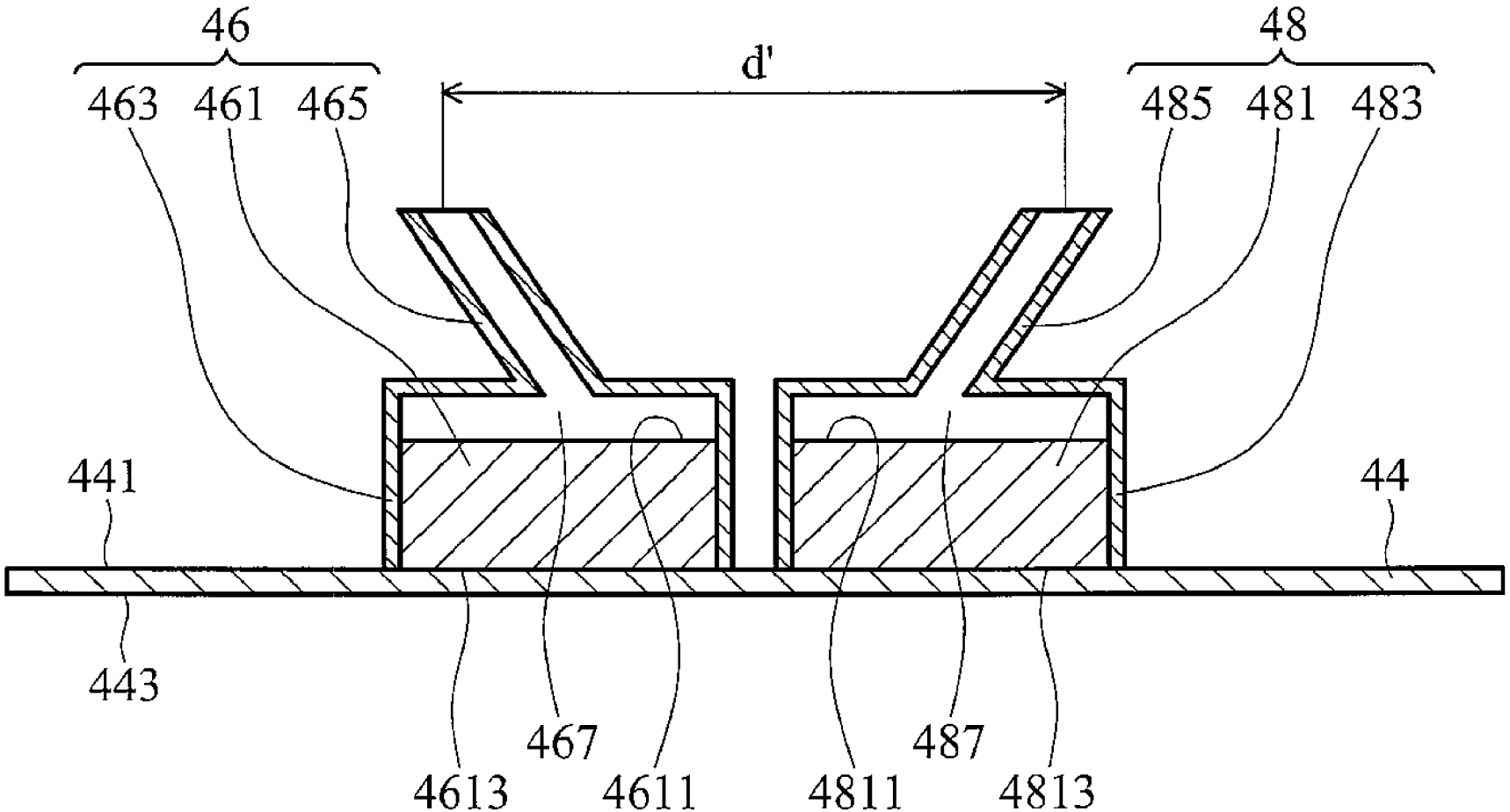
FIG. 4B is a sectional view of a microphone array and a circuit board in accordance with a third embodiment of the invention.

Referring to FIGS. 4A and 4B, a cellular phone 400 of a third embodiment of the invention includes a housing 42 in which a circuit board 44, a first microphone module 46, and a second microphone module 48 are disposed. The first microphone module 46 and the second microphone module 48 constitute a microphone array. The housing 42 has a first opening 421 and a second opening 423.

The circuit board 44 has a first surface 441 and a second surface 443 opposing the first surface 441. The first microphone module 46 and the second microphone module 48 are mounted on the first surface 441 of the circuit board 44.

The first microphone module 46 includes a first omnidirectional microphone 461, a first boot 463 housing the first omnidirectional microphone 461, and a first tube 465 extending from the first boot 463 to the first opening 421 of the housing 42. The first boot 463 is connected to the first surface 441 of the circuit board 44 by, for example, glue. The first omnidirectional microphone 461 has a first front surface 4611 receiving external sound via the first tube 465 as well as the first opening 421, and a first rear surface 4613 connected to the first surface 441 of the circuit board 44 via surface-mount technology (SMT). A first cavity 467 is formed between the first boot 463 and the first front surface 4611 of the first omnidirectional microphone 461. In this embodiment, the first boot 463 and the first tube 465 are integral.

The second microphone module 48 includes a second omnidirectional microphone 481, a second boot 483 housing the second omnidirectional microphone 481, and a second tube 485 extending from the second boot 483 to the second opening 423 of the housing 42. The second boot 483 is connected to the first surface 441 of the circuit board 44 by, for example, glue. The second omnidirectional microphone 481 and the first omnidirectional microphone 461 are identical, thus having the same polar pattern and performance. The second omnidirectional microphone 481 has a second front surface 4811 receiving external sound via the second tube 485 as well as the second opening 423, and a second rear surface 4813 connected to the first surface 441 of the circuit board 44 via surface-mount technology (SMT). A second cavity 487 is formed between the second boot 483 and the second front surface 4811 of the second omnidirectional microphone 481. The second boot 483 and the second tube 485 are integral.

In this embodiment, the first and second cavities 467 and 487 are identical, enabling the first omnidirectional microphone 461 in the first boot 463 and the second omnidirectional microphone 481 in the second boot 483 to have the same performance, wherein the first and second omnidirectional microphones 461 and 481 are identical as described above. Furthermore, the first and second cavities 467 and 487 are as small as possible, for reducing the sizes of the first and second boots 463 and 483 to a minimum, saving the space in the cellular phone 400, and maintaining the performance of the first and second omnidirectional microphones 461 and 481 in good shape.

The first omnidirectional microphone 461 is enclosed by the circuit board 44 and the first boot 463, both of which are acoustic isolators. Thus, the first omnidirectional microphone 461 merely receives external sound via the first tube 465. Similarly, the second omnidirectional microphone 481 is enclosed by the circuit board 44 and the second boot 483 both of which are acoustic isolators. Thus, the second omnidirectional microphone 481 merely receives external sound via the second tube 485. It is therefore understood that sound transmission between the first microphone module 46 and the second microphone module 48 is prevented.

The directivity of the microphone array is determined by the distance d' between the first opening 421 and the second opening 423. In this embodiment, the first tube 465 and the second tube 485 are not parallel. Thus, the distance d' between the first opening 421 and the second opening 423 can exceed that between the first microphone module 46 and the second microphone module 48.

In the described embodiments, the first microphone module and the second microphone module are mounted side-by-side on the circuit board. In the next embodiment, however, the first microphone module and the second microphone module are mounted back-to-back on the circuit board.

Figure 5A:
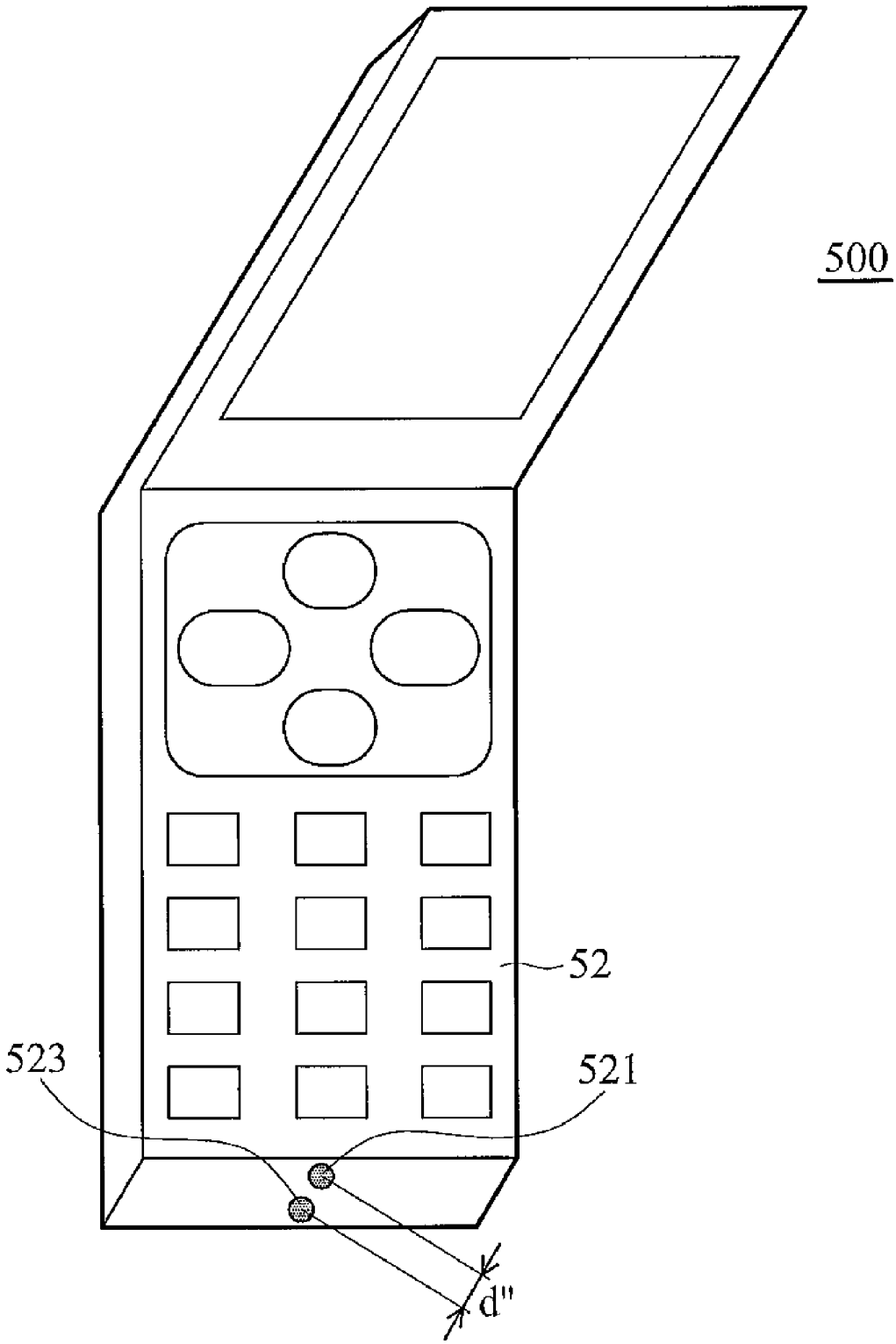
FIG. 5A is a schematic view showing a cellular phone in accordance with a fourth embodiment of the invention.
Figure 5B:
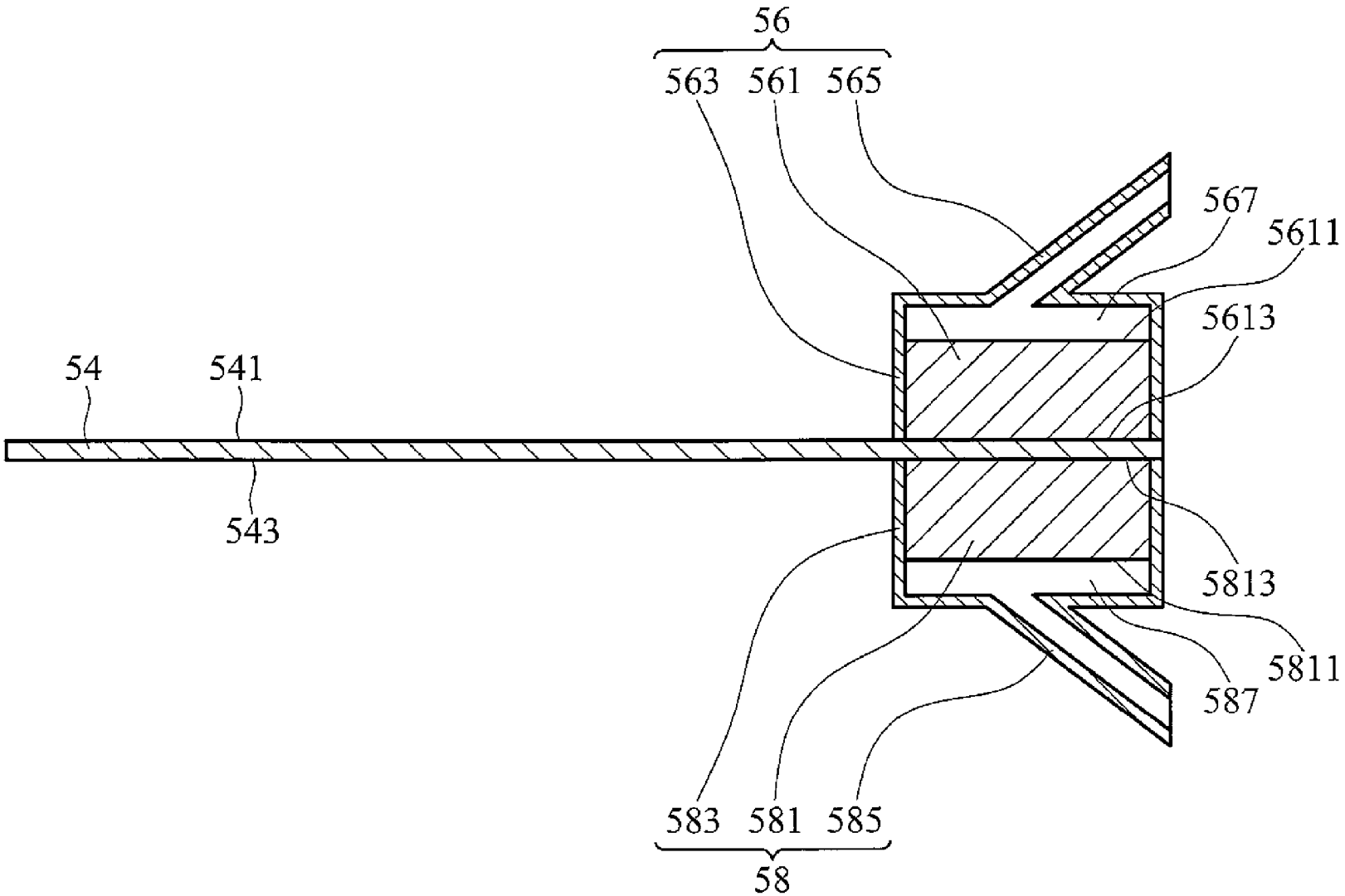
FIG. 5B is a sectional view of a microphone array and a circuit board in accordance with a fourth embodiment of the invention.

Referring to FIGS. 5A and 5B, a cellular phone 500 of a fourth embodiment of the invention includes a housing 52 in which a circuit board 54, a first microphone module 56, and a second microphone module 58 are disposed. The first microphone module 56 and the second microphone module 58 constitute a microphone array. The housing 52 has a first opening 521 and a second opening 523 on the bottom thereof.

The circuit board 54 has a first surface 541 and a second surface 543 opposing the first surface 541. The first microphone module 56 and the second microphone module 58 are respectively mounted on the first surface 541 and the second surface 543 of the circuit board 54.

The first microphone module 56 includes a first omnidirectional microphone 561, a first boot 563 housing the first omnidirectional microphone 561, and a first tube 565 extending from the first boot 563 to the first opening 521 of the housing 52. The first boot 563 is connected to the first surface 541 of the circuit board 54 by, for example, glue. The first omnidirectional microphone 561 has a first front surface 5611 receiving external sound via the first tube 565 as well as the first opening 521, and a first rear surface 5613 connected to the first surface 541 of the circuit board 54 via surface-mount technology (SMT). A first cavity 567 is formed between the first boot 563 and the first front surface 5611 of the first omnidirectional microphone 561. In this embodiment, the first boot 563 and the first tube 565 are integral.

The second microphone module 58 includes a second omnidirectional microphone 581, a second boot 583 housing the second omnidirectional microphone 581, and a second tube 585 extending from the second boot 583 to the second opening 523 of the housing 52. The second boot 583 is connected to the second surface 543 of the circuit board 54 by, for example, glue. The second omnidirectional microphone 581 and the first omnidirectional microphone 561 are identical, thus having the same polar pattern and performance. The second omnidirectional microphone 581 has a second front surface 5811 receiving external sound via the second tube 585 as well as the second opening 523, and a second rear surface 5813 connected to the second surface 543 of the circuit board 54 via surface-mount technology (SMT). A second cavity 587 is formed between the second boot 583 and the second front surface 5811 of the second omnidirectional microphone 581. The second boot 583 and the second tube 585 are integral.

In this embodiment, the first and second cavities 567 and 587 are identical, which enables the first omnidirectional microphone 561 in the first boot 563 and the second omnidirectional microphone 581 in the second boot 583 to have the same performance, wherein the first and second omnidirectional microphones 561 and 581 are identical as described above. Furthermore, the first and second cavities 567 and 587 are as small as possible, for reducing the sizes of the first and second boots 563 and 583 to a minimum, saving the space in the cellular phone 500, and maintaining the performance of the first and second omnidirectional microphones 561 and 581 in good shape.

The first omnidirectional microphone 561 is enclosed by the circuit board 54 and the first boot 563, both of which are acoustic isolators. Thus, the first omnidirectional microphone 561 merely receives external sound via the first tube 565. Similarly, the second omnidirectional microphone 581 is enclosed by the circuit board 54 and the second boot 583, both of which are acoustic isolators. Thus, the second omnidirectional microphone 581 merely receives external sound via the second tube 585. It is therefore understood that sound transmission between the first microphone module 56 and the second microphone module 58 is prevented.

The directivity of the microphone array is determined by the distance d" between the first opening 521 and the second opening 523. In this embodiment, the first tube 565 and the second tube 585 are not parallel. Thus, the distance d" between the first opening 221 and the second opening 223 can exceed that between the first microphone module 56 and the second microphone module 58.

Figure 6:
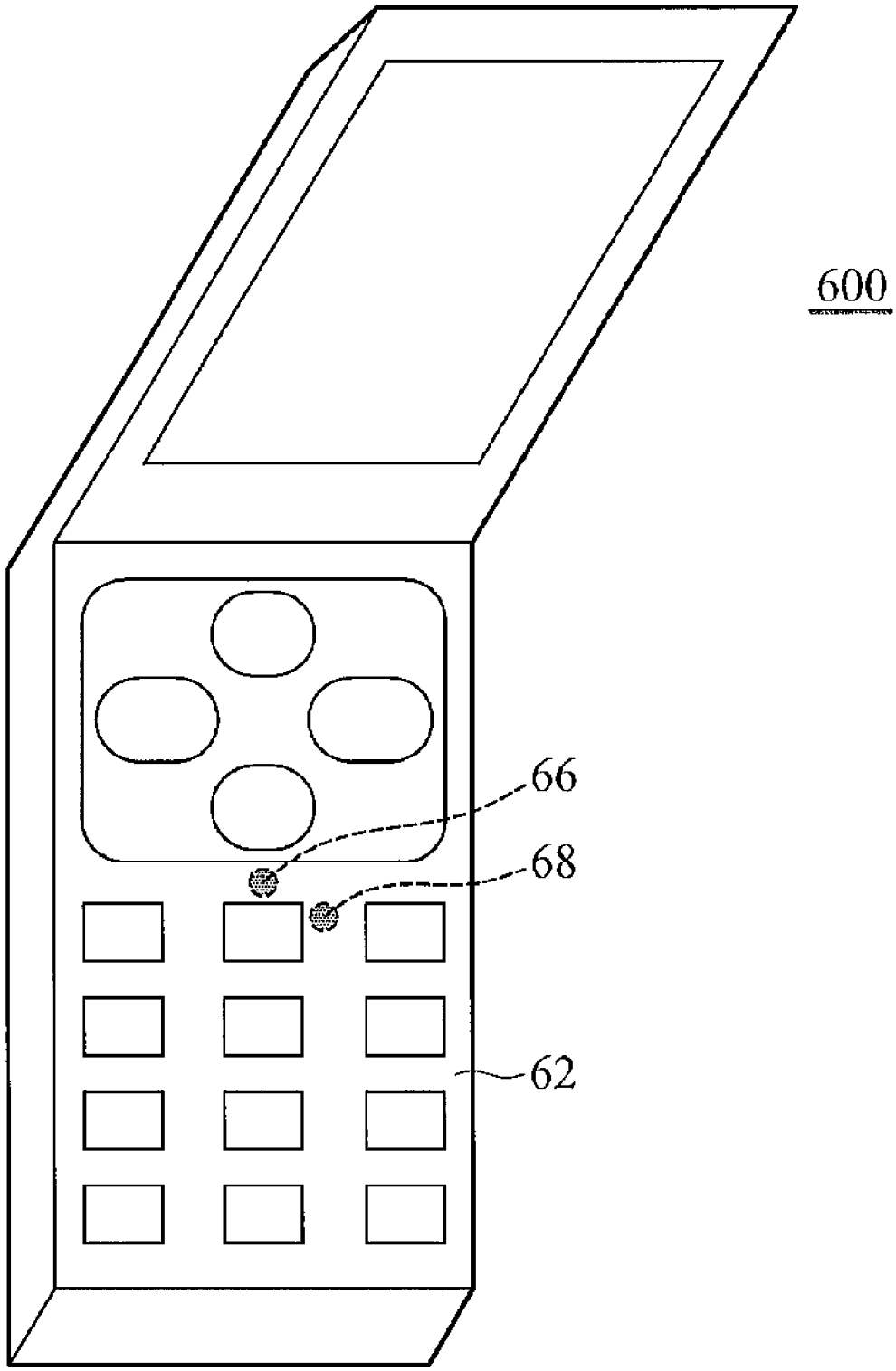
FIG. 6 is a schematic view showing a cellular phone in accordance with a fifth embodiment of the invention.

It is understood that the arrangement of the first omnidirectional microphone and the second omnidirectional microphone can be modified. In FIG. 6, for example, the first omnidirectional microphone 66 and the second omnidirectional microphone 68 are angled in a row in the housing 62 of a cellular phone 600.

Figure 7:
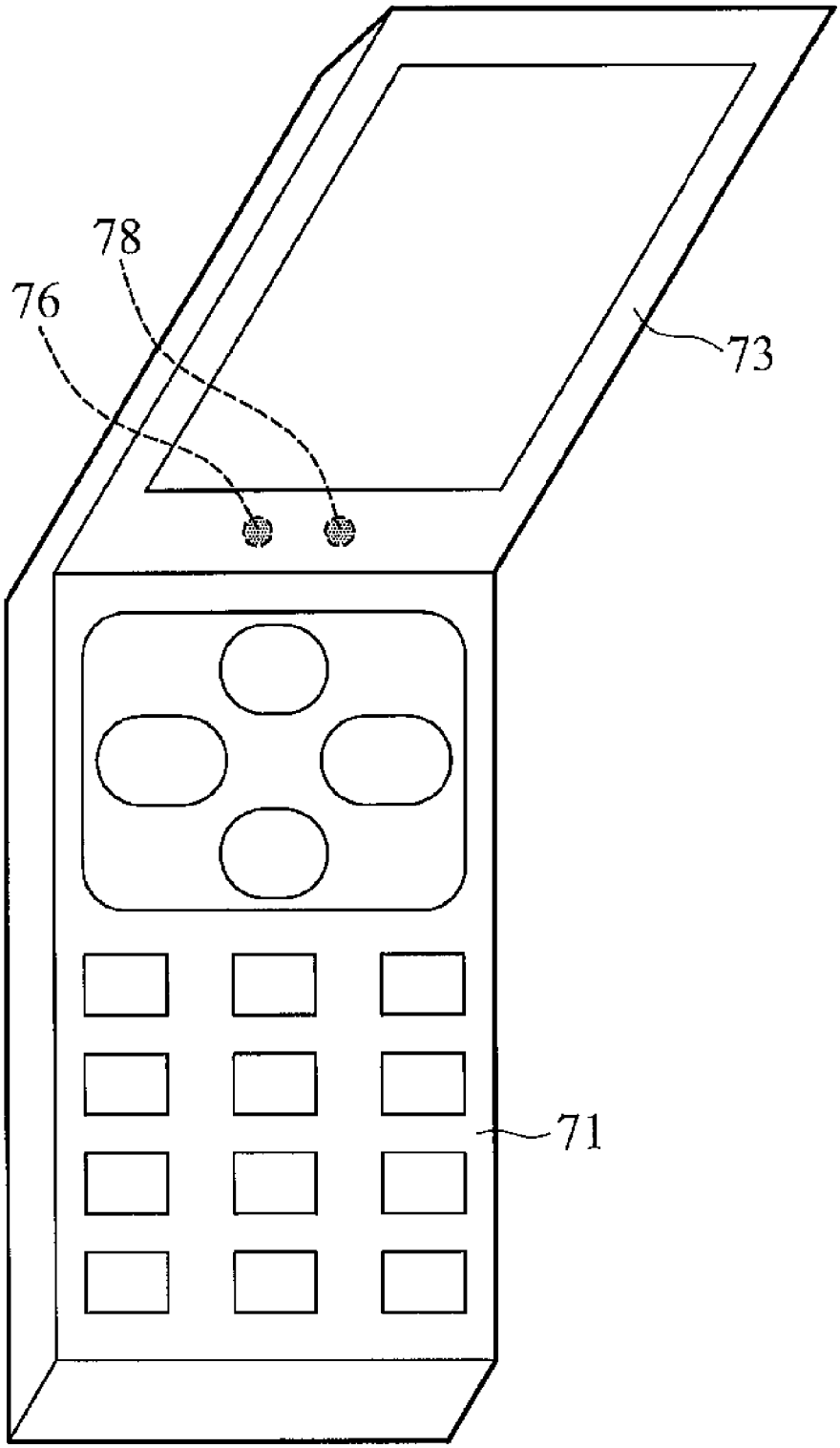
FIG. 7 is a schematic view showing a cellular phone in accordance with a sixth embodiment of the invention.

In the described embodiments, the first omnidirectional microphone and the second omnidirectional microphone are disposed in the body part of the cellular phone. It is understood, however, that the locations of the first omnidirectional microphone and the second omnidirectional microphone can be changed. In FIG. 7, for example, the first omnidirectional microphone 76 and the second omnidirectional microphone 78 are disposed in the screen part 73 instead of the body part 71.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic device, comprising:

a circuit board having a first surface and a second surface opposing the first surface; and two microphone modules mounted on the circuit board, wherein the microphone modules having the same polar pattern and are acoustically isolated from each other;

wherein each microphone module comprises an omnidirectional microphone, a boot and a tube, the omnidirectional microphone has a front surface receiving sound and a rear surface opposing the front surface, the front surface of the omnidirectional microphone is connected to the second surface of the circuit board, the boot is connected to the first surface of the circuit board, and the tube extends from the boot.

2. The electronic device as claimed in claim 1, further comprising a housing, wherein the circuit board and the microphone modules are disposed in the housing, an opening is defined in the housing, and the tube is connected to the opening.

3. The electronic device as claimed in claim 1, wherein the boot and the tube are integral.

4. The electronic device as claimed in claim 1, wherein the circuit board further has a through hole between the boot and the omnidirectional microphone.

5. The electronic device as claimed in claim 1, wherein the microphone modules are mounted side-by-side on the circuit board.

6. The electronic device as claimed in claim 1, wherein the electronic device comprises a cellular phone, a personal digital assistant, or a global positioning system receiver.

7. An electronic device, comprising:

a circuit board having a first surface and a second surface opposing the first surface;

a first microphone module comprising a first omnidirectional microphone connected to the second surface of the circuit board, a first boot connected to the first surface of the circuit board, and a first tube extending from the first boot; and a second microphone module comprising a second omnidirectional microphone connected to the second surface of the circuit board, a second boot connected to the first surface of the circuit board, and a second tube extending from the second boot, wherein the first and second omnidirectional microphones have the same polar pattern, and the first and second boots are identical.

8. The electronic device as claimed in claim 7, further comprising a housing, wherein the circuit board, the first microphone module, and the second microphone module are disposed in the housing, a first opening and a second opening are defined in the housing, the first tube is connected to the first opening, and the second tube is connected to the second opening.

9. The electronic device as claimed in claim 7, wherein the first tube and the second tube are parallel.

10. The electronic device as claimed in claim 7, wherein the first omnidirectional microphone has a first front surface receiving sound and a first rear surface opposing the first front surface, and the second omnidirectional microphone has a second front surface receiving the sound and a second rear surface opposing the second front surface.

11. The electronic device as claimed in claim 7, wherein the electronic device comprises a cellular phone, a personal digital assistant, or a global positioning system receiver.

12. An electronic device, comprising:

a circuit board having a first surface and a second surface opposing the first surface;

a first microphone module comprising a first omnidirectional microphone connected to the first surface of the circuit board, a first boot also connected to the first surface of the circuit board, and a first tube extending from the first boot; and a second microphone module comprising a second omnidirectional microphone connected to the second surface of the circuit board, a second boot also connected to the second surface of the circuit board, and a second tube extending from the second boot, wherein the first and second omnidirectional microphones have the same polar pattern, and the first and second boots are identical.

* * * * *